US005947405A

United States Patent [19]

Olischläger

[11] Patent Number: 5,947,405

[45] Date of Patent: Sep. 7, 1999

[54] METHOD FOR OPTIMIZING A BATCH CHANGE IN AN OPEN-END SPINNING MACHINE

[75] Inventor: Konrad Olischläger, Duisburg, Germany

[73] Assignee: W. Schlafhorst AG & Co., Moenchengladbach, Germany

[21] Appl. No.: 09/223,746

[22] Filed: Dec. 31, 1998

Related U.S. Application Data

[63] Continuation of application No. 08/970,954, Nov. 14, 1997, abandoned.

[30] Foreign Application Priority Data

Nov. 21, 1996 [DE] Germany ..... 196 48 215

[51] Int. Cl.[6] ..... B65H 54/02; D01H 7/46

[52] U.S. Cl. ..... 242/473.5; 57/264

[58] Field of Search ..... 242/473.5, 470; 57/264, 265; 364/470.1

[56] References Cited

U.S. PATENT DOCUMENTS

| | | | |
|---|---|---|---|
| 4,809,919 | 3/1989 | Ueda et al. | 242/474.1 |
| 4,856,723 | 8/1989 | Tone | 242/473.5 |
| 4,913,373 | 4/1990 | Ueda | 242/473.5 |
| 4,964,054 | 10/1990 | Raasch | 57/264 X |
| 5,107,667 | 4/1992 | Tone et al. | 57/264 |

*Primary Examiner*—Michael Mansen

*Attorney, Agent, or Firm*—Kennedy Covington Lobdell & Hickman, LLP

[57] ABSTRACT

The method by which a batch is ended in a spinning machine has an effect on its efficiency. As the rule, the end of a batch is determined according to a preset time, the amount of yarn to be produced, or a preset number of bobbins. In order to end a batch with the greatest possible efficiency, the present invention sets the batch end at a time at which full bobbins have been produced at no greater than 75% of the spinning stations operating in producing the batch. A minimum winding condition to be attained by the bobbins is predetermined prior to the end of the batch. The time still required for attaining the minimum winding condition of the bobbins is determined, and those spinning stations whose bobbins cannot attain the minimum winding condition by the time of the predetermined batch end are shut down.

8 Claims, 3 Drawing Sheets

METHOD FOR OPTIMIZING A BATCH CHANGE IN AN OPEN-END SPINNING MACHINE

CROSS-REFERENCE TO RELATED APPLICATION

This is a continuation of co-pending U.S. patent application Ser. No. 08/970,954, filed Nov. 14, 1997, entitled METHOD FOR OPTIMIZING A BATCH CHANGE IN AN OPEN-END SPINNING MACHINE, now abandoned.

FIELD OF THE INVENTION

The present invention relates to a method for optimizing a batch change in an open-end spinning machine having a plurality of spinning stations in which bobbins are produced, wherein the winding status of the bobbins in current production can be determined.

BACKGROUND OF THE INVENTION

Each batch change in an open-end spinning machine results in a reduction of the efficiency of the machine which is caused by a multitude of factors. For example, the lowest downtime and effort is required if a change of the bobbin diameter is made while retaining the type and size of the bobbin tubes. Resetting of the machine to a new raw yarn material, a new fiber or fiber mixture, requires the greatest downtime and effort if, in addition to resetting, the machine must be completely cleaned.

Also, the process of how a batch is finished has a bearing on the efficiency of a spinning machine. As a rule, the end of a batch depends on two possible predetermined events, either at a predetermined time at which, for example, personnel is available for refitting a machine for a fresh batch, or on the amount of the yarn to be produced or the predetermined number of bobbins to be produced. If, for example, based on a predetermined time, the spinning machine is turned off at a set time during the running of a batch, bobbins in different winding conditions will be encountered at the individual spinning stations. Besides full, completely wound bobbins with yarn of first quality, there are also bobbins whose winding condition only permits their classification as bobbins of second quality and so-called remnant bobbins whose amount of yarn is not sufficient for employing them in weaving or knitting mills. While the bobbins of second quality can still be sold at a reduced price, as a rule remnant bobbins cannot be used and are therefore waste. A reduction in the amount of waste is possible only if the remaining yarn can be rewound. However, re-winding depends on whether there still is a usable amount of yarn remaining on a tube. The cost-intensive rewinding process reduces the net revenues which are obtained for bobbins fully wound in this manner.

A batch changing method for winding machines is described in German Patent Publication DE 37 33 788 C2, which is intended to make the production of 100% full cheeses possible. To this end, a number of full bobbins to be attained is preset at the start of the batch, from which the number of winding stations which take part in the production of this batch is subtracted in order to be able to fix the initiation of the ending period of the batch run to the difference formed from these two values. Thereafter, each winding station which has produced a full bobbin is shut down. As a result, the productivity of the winding machine is drastically reduced in the last phase of the batch run. However, the time required for the end phase of the batch run is greatly reduced in comparison with rotor spinning machines because the winding speed of winding machines is approximately ten times that of a rotor spinning machine. Furthermore, a winding machine customarily has maximally 60 winding stations, while as a rule rotor spinning machines typically have more than 200 spinning stations. The amount of the reduction in efficiency in spinning machines is therefore accordingly great.

A flowing batch change during the end phase of the batch run for reducing production losses in connection with open-end spinning machines is not possible in any event because of the group drives employed in such machines.

OBJECT AND SUMMARY OF THE INVENTION

It is accordingly an object of the present invention to provide an improved method for optimizing the completion of a batch in the operation of an open-end spinning machine.

This objective is achieved in accordance with the present invention by providing a method for optimizing batch spinning efficiency in an open-end spinning machine having a plurality of spinning stations in which textile yam bobbins are produced and wherein the winding status of the bobbins in current production can be determined, e.g., by a central control device or unit for the machine. According to the present invention, the method basically comprises (a) predetermining the spinning of the batch to terminate at a time following the initiation of the batch at which full bobbins have been completed at no greater than approximately 75% of all operating spinning stations, (b) prior to terminating the batch, predetermining a minimum winding condition to be attained by the bobbins, (c) during the spinning of the batch, determining for the bobbins still being formed the time required for attaining the minimum winding condition, and (d) stopping those spinning stations whose bobbins cannot attain the minimum winding condition by the time of the predetermined batch termination time.

In a preferred embodiment, the termination time of the batch is arbitrarily set at a time which is predetermined to enable all bobbins to attain the minimum winding condition. Preferably, the determining of the time required for attaining the minimum winding condition comprises determining the current winding condition of the bobbins and the predetermining of the termination time of the batch comprises determining a predetermined minimum number of full bobbins to be produced and determining an optimization of the times required for completing the predetermined minimum number of full bobbins.

The present invention further contemplates that, during the running of the batch, a central control device of the machine is utilized for determining the amount of yarn already spun, the amount of bobbins already wound and the number of bobbins which are currently in production, and determining the termination of the batch as a function of the total predetermined amount of production from the batch. It is also preferred to graphically represent the spinning of the batch in relation to the winding conditions of the bobbins.

In accordance with the invention, the full bobbins are sequentially removed in accordance with the predetermined winding conditions. As the bobbins are removed, the tubes of the old batch are exchanged with a supply of tubes for a new batch at the stopped spinning stations. Likewise, cans of sliver for a new batch are exchanged for the cans of sliver from the batch being spun at the stopped spinning stations.

By means of the present invention, a batch is ended at an advanced time such that the normal period of time for a so-called batch run-out is eliminated, because during such time spinning efficiency drops so seriously as to cause losses which exceed the difference in value between full bobbins, which can still be created during this run-out time, and bobbins with a lesser predetermined acceptable winding condition. The winding condition which at least must be attained depends on the intended use of the bobbins or the corresponding requirements of the respective buyer. As mentioned at the outset, bobbins which do not attain this minimum winding condition are waste. To reduce this waste to a minimum, the bobbin changing strategy of the invention is intended to prevent these remnant or waste bobbins. In particular, waste bobbins can generally be prevented if the period of time between the initiation of the ending period of the batch and the final termination of the batch (the so-called run-out phase) corresponds at least to the production time required for reaching the minimum winding condition starting with an empty tube. However, if this period of time from the initiation of the ending period of the batch until the final termination of the batch is insufficient to reach this minimum winding length, any such spinning station is stopped, whereby the additional production of waste during the run-out phase of the batch is prevented.

If the period between the initiation of the end of the batch and the final completion of the batch is greater than the period required for reaching the minimum winding condition, bobbin changes can be performed within the run-out phase of the batch until the period of time remaining until reaching the batch end corresponds to such minimum winding condition. In this manner, it is possible to postpone further toward the final completion of the batch the time at which the efficiency of the spinning machine by means of stopping the spinning stations begins to drops.

In accordance with the present invention, the final completion of the batch is arbitrarily predetermined to occur at or in advance of the time at which at most 75% of the spinning stations have produced full cheeses since the initiation of the batch change. Such an arbitrary end to a batch run is mainly utilized when it is known that the personnel required for a batch change will be available at a very definite time. Proceeding from a pre-set, arbitrarily determined batch termination, the invention makes it possible to set the time for initiating the batch ran-out sufficiently far ahead of the batch end so as to completely exclude waste or remnant bobbins.

If a corresponding leeway for setting the batch end is provided, for example if a defined amount of production is to be at least or to a large extent attained, the fluctuation of the completion times of bobbins within the run-out phase of the batch can be detected and utilized as a basis to achieve a significantly higher yield of full bobbins in relation to the reduction of efficiency which occurs during this period.

Since the actual winding condition of the bobbins at the spinning stations can be detected at any time, the progression of the batch up to the planned termination of the batch can be determined and, for example, represented graphically. It is therefore possible during the batch run-out period, for example, to plot a curve over time representing the percentage portion of the totality of the spinning stations which have not reached full bobbin capacity and therefore are still producing yarn. From such a graph, it is possible to see that, as the spinning stations progressively complete full bobbins, the curve drops until a time at which the last spinning station has produced a full bobbin. In turn it is possible to make a decision whether it would be useful to postpone a batch change and to keep the entire machine running for producing additional full bobbins. Such a graphical display of the batch progression permits an estimation to be made as to variances which will occur in the amount of bobbin production by varying the run-out times of the batch, as well as enabling a statement to be made regarding the run-out time of the batch by varying the amount of production.

In an advantageous manner, the present invention furthermore offers the possibility that the bobbins which have reached the predetermined desired winding condition may be removed sequentially one after the other in an order in accordance with their winding conditions. While it is currently still customary at the end of a batch to remove the full bobbins and the bobbins of second quality together from the spinning machine and to manually separate them after a visual check, it is possible in accordance with the present invention to remove these bobbins separately from the spinning machine. Since the winding condition of any bobbin still clamped in its winding station is known, it is possible by an appropriate control of the bobbin changer at the spinning machine to perform removal in accordance with the winding condition of the bobbins. If the operative bobbin changing tools of the bobbin changer are unable to change remnant bobbins of less than a defined diameter, these bobbins, which occur less frequently, can be manually removed. Thus, the present invention makes it possible to remove the produced bobbins in accordance with their winding conditions such that they can be initially organized according to their respective winding conditions during removal.

If it is necessary during a batch change to replace the tubes currently being utilized for tubes of other sizes or types, this exchange can be begun as soon as the batch run-out period is initiated. During such period, no piecing of the yarn of the old batch takes place at the spinning stations which are stopped or from which a bobbin of the predefined winding condition is removed. Therefore, the run-out time until the final completion of the batch can be used to exchange the tube supply of the old batch with tubes of the new batch if a supply of tubes of the new batch is ready. The refitting of the spinning machine to begin a new batch can be further accelerated after the initiation of the batch run-out if the present supply of sliver of the old batch is not replenished at the spinning stations. If the sliver can transport is performed by an automatic can transport system, the can transport system can already be outfitted to deliver cans with sliver for the new batch while the old batch runs out. At the spinning stations which are shut-down during the run-out period for completing the old batch, it is furthermore possible to begin exchange of the sliver cans of the current batch being run-out with cans of sliver of the new batch. With spinning machines which are started by means of starter bobbins inserted into the spinning stations, the starter bobbin device can already be outfitted to the new batch during the batch run-out and the starter bobbins for the new batch can be inserted into the spinning stations as they are cleared of finished full bobbins (but of course the starter bobbins are not yet started at this time).

If an interruption in spinning occurs at a spinning station during a batch run-out, and if the predetermined completion of the batch cannot be maintained because of this interruption, an alarm is triggered. For example, an interruption in spinning operation of a spinning station or the loss of a spinning station may make it impossible to assure the completion of the intended number of full bobbins to be produced by the predetermined termination of the batch, particularly if the termination of the batch has been predetermined based on yarn amounts. Such an interruption can occur, besides for technical reasons, because of the lack of sliver, i.e. the emptying of a sliver can. In such a case, the alarm makes it possible either to correct or alter the predetermined goal of full bobbins, or to postpone the time of terminating the batch, or to exchange a can with an available remaining supply of sliver from a stopped spinning station for an empty can at the interrupted station. Under such circumstances, it is also possible to return into service a spinning station which has already been shut down with a bobbin of second quality, so that the deficient bobbin can be finished. In any case, the alarm and the identification of the interrupted spinning station provides the opportunity to controllingly intervene in the batch run-out.

Other features and details of the present invention will be explained and understood from the description of a representative preferred embodiment set forth below with reference to the graphic illustrations of the accompanying drawings.

DETAILED DESCRIPTION OF THE PREFERRED EMBODIMENT

Figure 1:
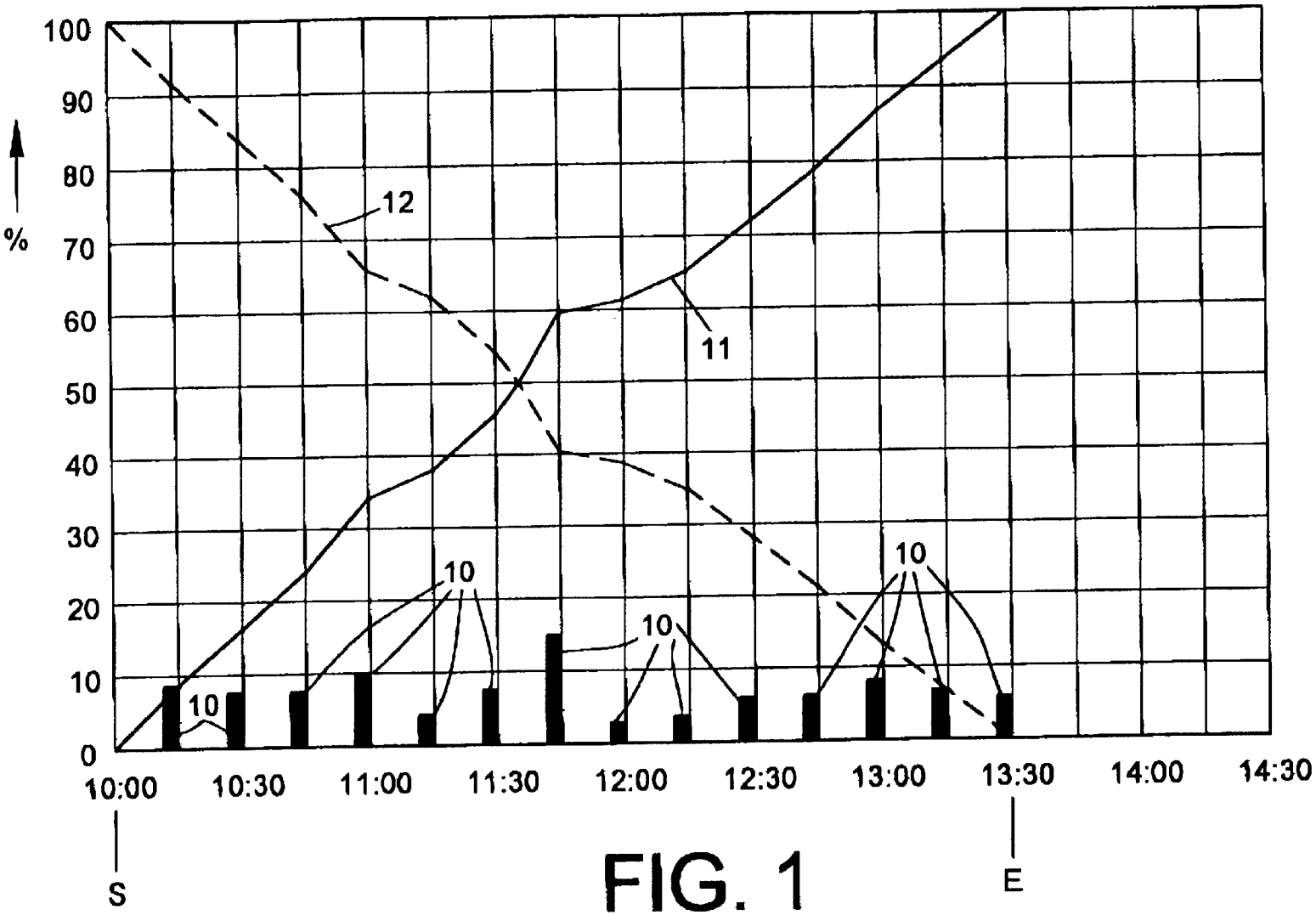
FIGS. 1–3 are diagrams which illustrate, respectively, the run-out of representative spinning batches in an open-end spinning machine in accordance with the present invention by means of graphs plotting the number of completed full bobbins against time over the course of the batch run-out.
Figure 2:
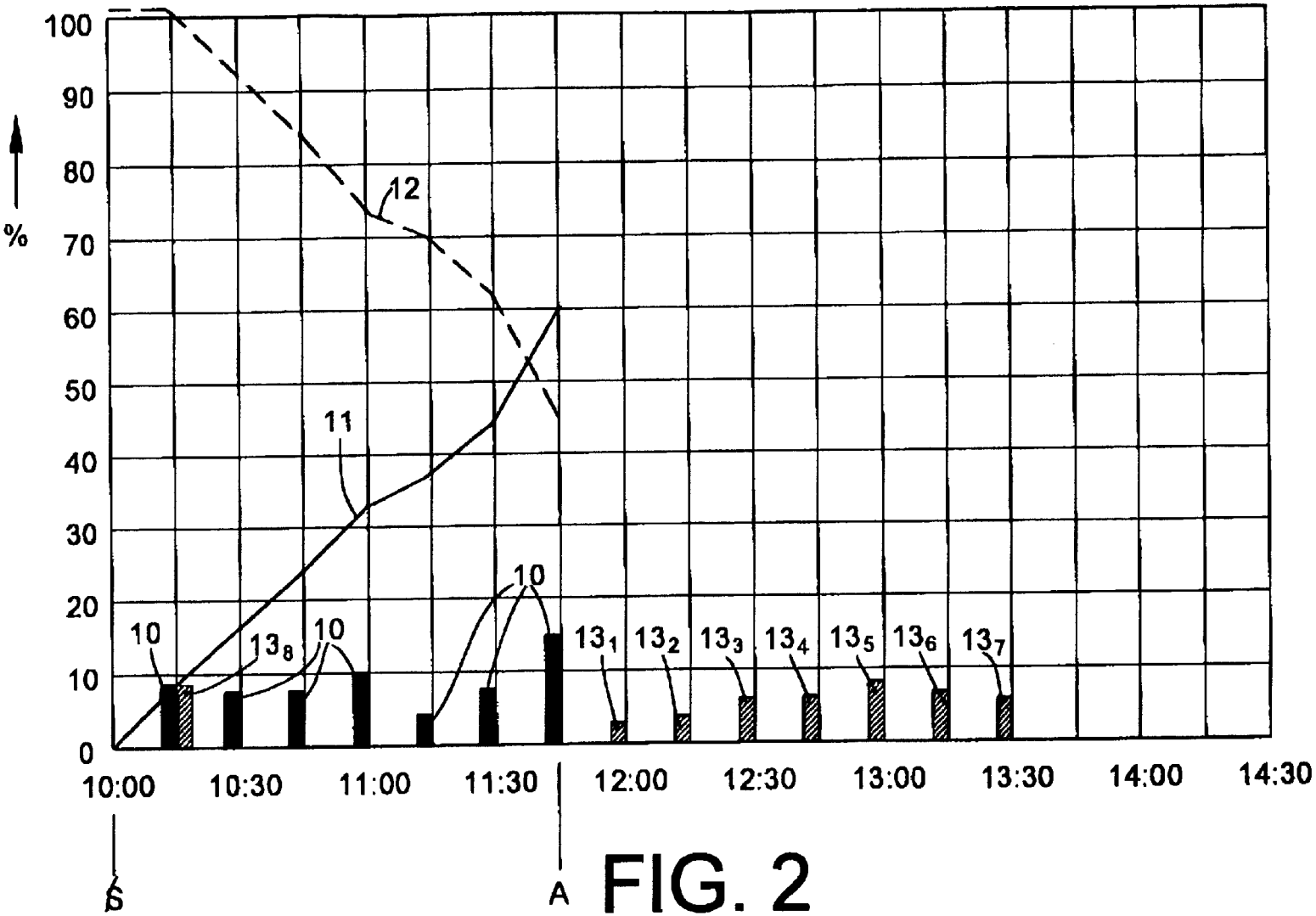
Figure 3:
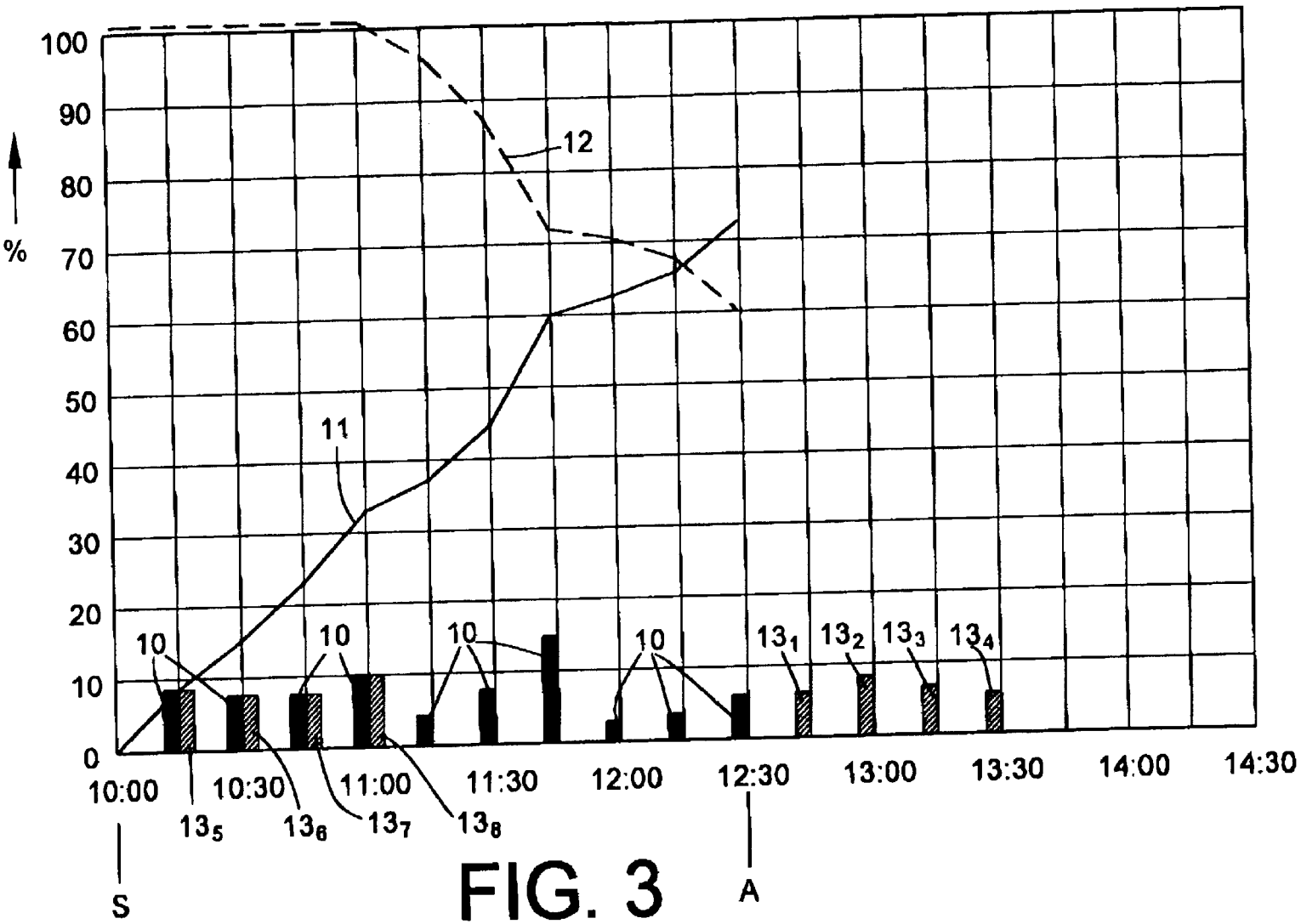

Referring now to the accompanying drawings, FIGS. 1–3 graphically illustrate the spinning progression of an open-end spinning batch starting at a call-up time of 10:00 hours (this time and all other clock times stated herein being according to a twenty four hour clock time system). In FIG. 1, the batch continues until the final termination of the batch under conventional conditions wherein the batch is not terminated until a full bobbin has been completed at each spinning station. Assuming a conventional spinning machine having 288 spinning stations, the time required to complete the batch of FIG. 1 with every spinning station producing a full bobbin would extend until approximately 13:30 hours later on the same day. FIG. 2 illustrates the completion (run-out) of the same batch with every spinning station being stopped at approximately 11:45 hours of the same day, in accordance with the present invention.

In each of the two diagrams, the graph plots the batch running time from the callup batch start along the abscissa of the graph, with the time being divided into quarter hour steps. The ordinate of each graph plots a percentage scale from 0 to 100 percent. In this manner, it is possible during the batch run-out to represent graphically the decreasing efficiency of the respective machine in percentage terms by plotting a curve signifying the decreasing percentage of the spinning stations still operating as the running time of the batch progresses toward the end of the batch, shown in each drawing by the broken line curve 12. The respective bar graphs 10 of each graph also represent, at the end of each progressive time increment, the percentage of the spinning stations which have completed full bobbins since the immediately preceding time increment. That is, at the end of each passing time interval, the number of full bobbins produced during this interval is symbolized by the bar graphs 10 in the form of a bar of appropriate length to represent the percentage of such number of bobbins relative to all full bobbins which can be produced during the batch run-out. Solid lines 11 in the two graphs represent the progressive percentage increase in spinning stations which have completed full bobbins relative to all operating spinning stations available to complete full bobbins until the theoretical end of the batch.

The two diagrams in FIGS. 1 and 2 represent different methods of completing a batch at an open end spinning machine in which a batch of a relatively coarse yarn is spun. The average spinning time required in each case for producing a full bobbin is approximately three and one-half hours. In this illustrative case, the minimum weight for bobbins to qualify as being of second quality, thereby representing the predetermined minimum winding condition, is set at a value of 1 kg of yarn.

Under these circumstances, the following situation can be predicted at 10:00 hours by means of the diagram in FIG. 1. After the first time interval at 10:15 hours, approximately 9 percent of all the bobbins which were in production in the machine at 10:00 hours will be full, as represented by the corresponding bar of the bar graph 10 at such 10:15 time increment. If a new bobbin is not started at each respective spinning station after each such full bobbin is completed, the number of operating spinning stations drops steadily and correspondingly, as can be seen by means of the broken line curve 12. At the same time, the number of finished full bobbins correspondingly rises, as can be seen from the solid line curve 11. Furthermore, the creation of full bobbins at the spinning stations will be steady until a time of approximately 11:15 hours, when only very few bobbins are finished, as can also be seen from the bar graph 10. Thereafter, the production of full bobbins increases significantly during the subsequent time period between 11:00 hours and approximately 11:45 hours, after which the number of full bobbins produced decreases significantly and continues at a relatively low level until the termination of the batch at 13:30 hours when every spinning station has finished a full bobbin.

Accordingly, in order to suffer the lowest possible loss of spinning efficiency, the batch is set to end at the earlier time of 11:45 hours in accordance with the present invention, as represented in FIG. 2. Thus, the cross-hatched bars $13_1$ to $13_8$ of the bar graph 13 represent the proportion of bobbins which will not achieve the fully wound condition because of this earlier predetermined termination of the batch. The proportion of all bobbins fully wound by this 11:45 hours termination of the batch is about 60% of all bobbins which were being spun in the spinning stations at the time of the initiation of the batch run-out. The proportion of bobbins of second quality, i.e., bobbins which are not full but have the predetermined minimum weight of yarn wound thereon, as represented by bars $13_1$ to $13_8$, is 47%. The proportion of remnant bobbins which have not attained the predetermined weight to qualify as second quality bobbins, i.e. whose weight lies below 1 kg, is 1 percent of the bobbins created during the batch run-out. When this batch spinning methodology is considered in light of the reduction of the total batch run-out time from approximately three and one-half hours under conventional operating conditions to only one and three-quarters hours under the present invention, the yield of full bobbins is superproportionally high while the proportion of remnant bobbins is negligibly small. Furthermore, the waste created by this operation is nearly zero since, in accordance with the invention, the respective spinning stations which complete full bobbins after the batch run-out begins at 10:00 and which are capable of further winding bobbins to reach the minimum winding condition (i.e., at least second quality) before the batch is ended at 11:45 hours, are freshly started, as represented by the bar $13_8$, while other spinning stations which complete full bobbins but cannot further wind new bobbins of at least second quality are shut down and not restarted.

The advantages of the batch run-out methodology of the present invention in improved efficiency and reduced production losses (waste) will be even greater in spinning operations wherein the running time of the batch is considerably longer than the batch of the preceding exemplary embodiment, e.g. with spinning of finer count yarns.

The batch progression in FIG. 3 corresponds to that of FIGS. 1 and 2 except that the end of the batch would be arbitrarily set in accordance with the present invention to occur at 12:30 hours on the same day the batch is started. The elapsed time from the batch starting time around 10:00 hours until the predetermined batch end at 12:30 hours will be seen to be sufficient for additionally producing bobbins of second quality of the predetermined winding condition of 1 kg at least some of the spinning stations at which bobbins of first quality are produced early in the batch running time, represented by bars $13_5$–$13_8$. Therefore the curve 12, which represents the percentage of the spinning stations which are still operating and would produce only bobbins of first quality, begins to drop from the 100% mark only when there is no longer sufficient time for producing a bobbin of this predetermined second quality winding condition.

At the predetermined end of the batch at 12:30 hours, about 72% of all bobbins being wound have been completed as full bobbins, as represented by curve 11. The total proportion of bobbins of second quality, represented by bars $13_1$–$13_8$, is correspondingly higher at a percentage of 59%. No remnant bobbins are produced having yarn under the predetermined weight of bobbins of second quality. The cross-hatched bars of the bar graph 13 indicate the percentage share of full bobbins which was not attained because of the predetermined earlier than conventional batch end.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In an open-end spinning machine having a plurality of spinning stations in which textile yarn bobbins are produced and wherein the winding status of the bobbins in current production can be determined, a method for optimizing efficiency in spinning a batch of bobbins, the method comprising:

predetermining the spinning of the batch to terminate at a time at which full bobbins have been completed at no greater than approximately 75% of all operating spinning stations, predetermining a minimum winding condition to be attained by the bobbins, during the spinning of the batch, determining for the bobbins still being formed the time required for attaining the minimum winding condition, and stopping those spinning stations whose bobbins cannot attain the minimum winding condition by the time of the predetermined batch termination time.

2. The method in accordance with claim 1, wherein the predetermining step comprises predicting the subsequent times at which the respective spinning stations will progressively complete full spinning bobbins and selecting the termination time of the batch to enable substantially all bobbins to attain at least the minimum winding condition.

3. The method in accordance with claim 1, wherein the determining of the time required for attaining the minimum winding condition comprises determining the current winding condition of the bobbins and the predetermining of the termination time of the batch comprises determining a predetermined minimum number of full bobbins to be produced and determining an optimization the times required for completing the predetermined minimum number of full bobbins.

4. The method in accordance with claim 3, and further comprising, during the spinning running of the batch, determining the amount of yarn already spun, the amount of bobbins already wound and the number of bobbins which are currently in production, and determining the termination of the batch as a function thereof.

5. The method in accordance with claim 1, wherein the stopping step comprises, when a spinning station completes a full bobbin, restarting the spinning station if sufficient time remains to spin another bobbin to attain at least the minimum winding condition before the predetermined batch termination time or stopping the spinning station if insufficient time remains to spin another bobbin to attain at least the minimum winding condition before the predetermined batch termination time.

6. The method in accordance with claim 5, and further comprising preparing the spinning machine for spinning a second batch of bobbins after the predetermined batch termination time, including exchanging the bobbins of the first-mentioned batch with a supply of empty spinning tubes for the second batch.

7. The method in accordance with claim 6, wherein the exchanging of bobbins of the first-mentioned batch comprises equipping stopped spinning stations with tubes of the second batch.

8. The method in accordance with claim 7, the spinning of the first-mentioned batch comprises feeding slivers from sliver cans to the spinning stations, and the preparing the spinning machine for spinning a second batch comprises exchanging cans of sliver for the second batch for the cans of sliver from the first-mentioned batch at the stopped spinning stations.

* * * * *